US011377825B2

(12) United States Patent
Koga

(10) Patent No.: US 11,377,825 B2
(45) Date of Patent: Jul. 5, 2022

(54) SHOVEL, METHOD FOR CONTROLLING SHOVEL, AND MOBILE INFORMATION TERMINAL

(71) Applicant: SUMITOMO HEAVY INDUSTRIES, LTD., Tokyo (JP)

(72) Inventor: Masato Koga, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 226 days.

(21) Appl. No.: 16/545,200

(22) Filed: Aug. 20, 2019

(65) Prior Publication Data

US 2019/0376262 A1 Dec. 12, 2019

Related U.S. Application Data

(63) Continuation of application No. PCT/JP2018/006706, filed on Feb. 23, 2018.

(30) Foreign Application Priority Data

Feb. 24, 2017 (JP) ..... JP2017-033877

(51) Int. Cl.
*E02F 9/26* (2006.01)
*E02F 3/32* (2006.01)
*E02F 3/43* (2006.01)

(52) U.S. Cl.
CPC ..... *E02F 9/264* (2013.01); *E02F 3/32* (2013.01); *E02F 3/435* (2013.01)

(58) Field of Classification Search
CPC ..... E02F 3/32; E02F 3/435; E02F 9/20; E02F 9/2041; E02F 9/2045; E02F 9/24; E02F 9/26; E02F 9/264; E02F 9/265
See application file for complete search history.

(56) References Cited

U.S. PATENT DOCUMENTS 5,446,981 A * 9/1995 Kamada ..... E02F 3/437 172/2
5,822,891 A * 10/1998 Fujishima ..... E02F 9/2033 37/348

(Continued)

FOREIGN PATENT DOCUMENTS

EP 2407648 1/2012
JP H05-064254 U 8/1993

(Continued)

OTHER PUBLICATIONS

International Search Report for PCT/JP2018/006706 dated Apr. 10, 2018.

*Primary Examiner* — Tyler J Lee
(74) *Attorney, Agent, or Firm* — IPUSA, PLLC

(57) ABSTRACT

A shovel includes a lower traveling body, an upper rotating body that is rotatably mounted on the lower traveling body, an attachment attached to the upper rotating body, state detecting sensors that detect operational states of components of the shovel and include an attitude sensor that detects an attitude of the attachment, a controller that executes a preset operation based on a detection value detected by the attitude sensor, and a storage that stores detection values detected by the state detecting sensors during execution of the preset operation by the controller in association with the preset operation.

13 Claims, 6 Drawing Sheets

(56) References Cited

U.S. PATENT DOCUMENTS

| | | | | |
|---|---|---|---|---|
| 8,589,038 | B2 * | 11/2013 | Hagiwara | F15B 11/024 701/50 |
| 9,256,227 | B1 | 2/2016 | Wei et al. | |
| 2002/0103623 | A1 | 8/2002 | Hasegawa et al. | |
| 2012/0000191 | A1 * | 1/2012 | Hagiwara | E02F 9/2246 60/311 |
| 2012/0003069 | A1 * | 1/2012 | Hagiwara | E02F 9/2285 414/685 |
| 2012/0296574 | A1 | 11/2012 | Ooki et al. | |
| 2015/0240445 | A1 * | 8/2015 | Guo | E02F 3/435 701/50 |
| 2016/0005286 | A1 * | 1/2016 | Kiyota | G08B 13/196 340/435 |
| 2016/0076223 | A1 | 3/2016 | Wei et al. | |
| 2017/0073934 | A1 * | 3/2017 | Kiyota | E02F 9/24 |

FOREIGN PATENT DOCUMENTS

| | | |
|---|---|---|
| JP | 2000-055791 | 2/2000 |
| JP | 2003-104688 | 4/2003 |
| JP | 2010-075798 | 4/2010 |
| JP | 2012-241426 | 12/2012 |
| JP | 2015-063864 | 4/2015 |
| JP | 2016-186210 | 10/2016 |

* cited by examiner

SHOVEL, METHOD FOR CONTROLLING SHOVEL, AND MOBILE INFORMATION TERMINAL

RELATED APPLICATIONS

The present application is a continuation application filed under 35 U.S.C. 111(a) claiming benefit under 35 U.S.C. 120 and 365(c) of PCT International Application No. PCT/JP2018/006706 filed on Feb. 23, 2018, which is based on and claims the benefit of priority of Japanese Patent Application No. 2017-033877 filed on Feb. 24, 2017, the entire contents of which are incorporated herein by reference.

BACKGROUND

Technical Field

An aspect of this disclosure relates to a shovel, a method for controlling the shovel, and a mobile information terminal.

Description of Related Art

There is a known shovel where an operator performs a preset operation according to instructions in the preset operation displayed on a display device in a cabin, and values detected by sensors while the preset operation is performed by the operator are stored in a storage in association with the preset operation. For example, the values detected by the sensors and associated with the preset operation are transmitted to a management apparatus and used for the diagnosis of failure of the shovel.

Here, because a shovel includes a large number of driven parts, a preset operation is complicated. Accordingly, it is burdensome for an operator to perform a preset operation according to instructions in the preset operation displayed on the display device in the cabin. Also, operational variations tend to occur due to differences in the skill of operators.

SUMMARY

According to an aspect of this disclosure, a shovel includes a lower traveling body, an upper rotating body that is rotatably mounted on the lower traveling body, an attachment attached to the upper rotating body, state detecting sensors that detect operational states of components of the shovel and include an attitude sensor that detects an attitude of the attachment, a controller that executes a preset operation based on a detection value detected by the attitude sensor, and a storage that stores detection values detected by the state detecting sensors during execution of the preset operation by the controller in association with the preset operation.

DETAILED DESCRIPTION

Below, embodiments of the present invention are described with reference to drawings. Throughout the drawings, the same reference number is assigned to the same component, and repeated descriptions of the component may be omitted.

Figure 1:
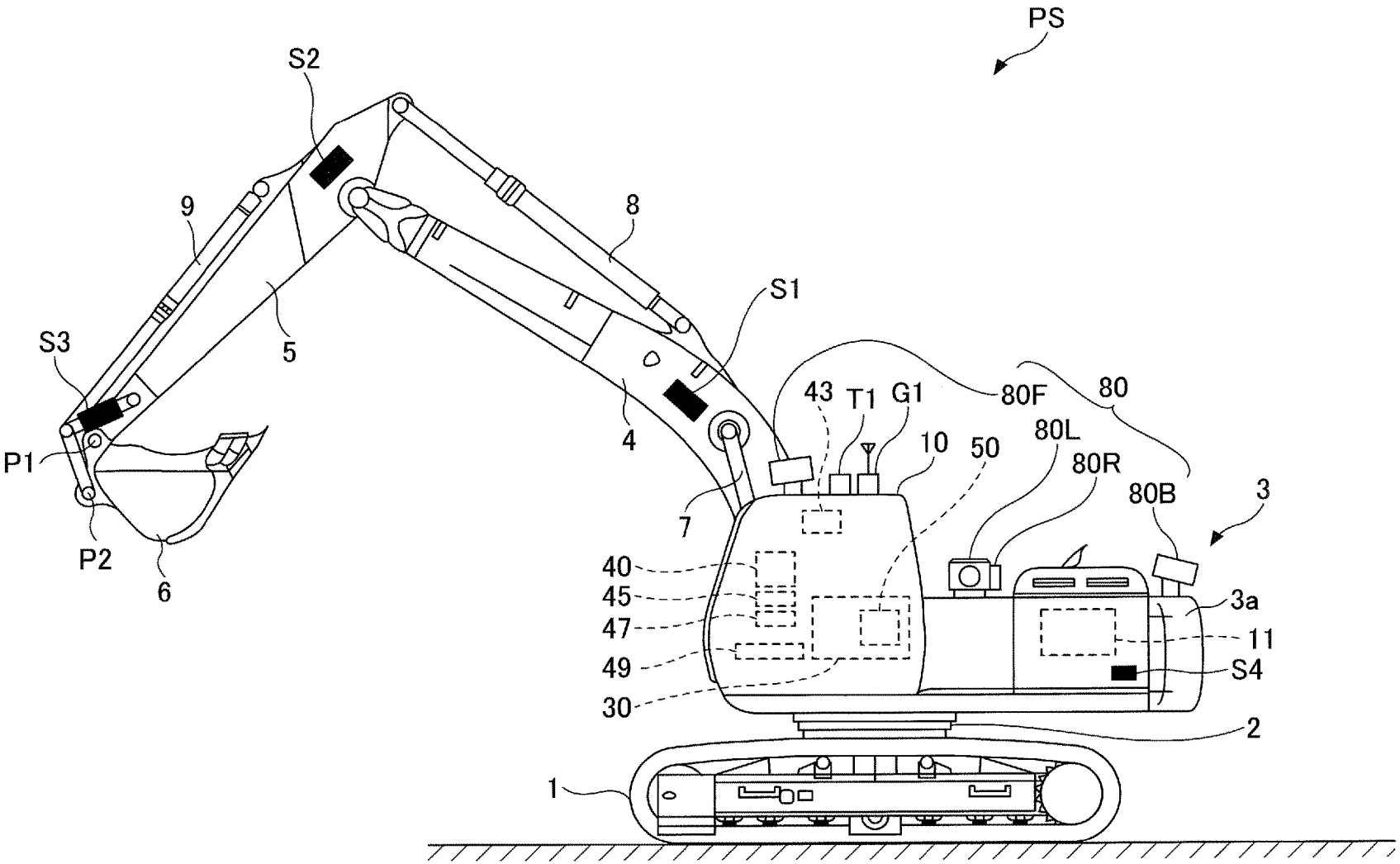
FIG. 1 is a side view of an example of a shovel according to an embodiment of the present invention.

FIG. 1 is a side view of an example of a shovel according to an embodiment of the present invention.

A shovel PS includes a lower traveling body 1 on which an upper rotating body 3 is rotatably mounted via a rotation mechanism 2. A boom 4 is attached to the upper rotating body 3. An arm 5 is attached to an end of the boom 4. A bucket 6 is attached as an end attachment (working part) to an end of the arm 5 with an arm top pin P1 and a bucket link pin P2. Other examples of end attachments include a slope finishing bucket, a dredging bucket, and a breaker.

The boom 4, the arm 5, and the bucket 6 constitute an excavation attachment as an example of an attachment, and are hydraulically driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. The excavation attachment may include a bucket tilting mechanism. The boom angle sensor S1, the arm angle sensor S2, and the bucket angle sensor S3 may also be referred to as "attitude sensors".

The upper rotating body 3 includes a power source such as an engine 11 and a body tilt sensor S4 that are covered by a cover 3*a*. An imaging apparatus 80 is provided on an upper surface of the cover 3*a* of the upper rotating body 3. The imaging apparatus 80 includes a front monitoring camera 80F, a left-side monitoring camera 80L, a rear monitoring camera 80B, and a right-side monitoring camera 80R.

The upper rotating body 3 includes a cabin 10 as an operator cab. A GPS device (GNSS receiver) G1 and a transmitter T1 are provided on the top of the cabin 10. The GPS device (GNSS receiver) G1 detects the position of the shovel PS using a GPS function, and provides positional data to a machine guidance device 50 in a controller 30. The transmitter T1 transmits information to the outside of the shovel PS. For example, the transmitter T1 transmits information that a management apparatus 90 described later can receive. Also, the controller 30, a display device 40, an audio output device 43, an input device 45, and a storage device 47 are provided in the cabin 10.

The controller 30 functions as a main controller for driving and controlling the shovel PS. The controller 30 is a processor including a CPU and an internal memory. The CPU executes a program stored in the internal memory to implement various functions of the controller 30.

The controller 30 also functions as the machine guidance device 50 for guiding the operations of the shovel PS. For example, the machine guidance device 50 provides an operator with work information such as a distance between a target surface, which is a surface of a target land set by the operator, and a working part of an attachment. The distance between the target surface and the working part of the attachment is, for example, a distance between the target surface and an end (tip) of the bucket 6 as an end attachment, the back side of the bucket 6, or an end of a breaker as an end attachment. The machine guidance device 50 provides the operator with work information via, for example, the display device 40 and the audio output device 43, and thereby guides the operations of the shovel PS.

Although the machine guidance device 50 is provided in the controller 30 in the present embodiment, the machine guidance device 50 and the controller 30 may be provided separately. In this case, similarly to the controller 30, the machine guidance device 50 is implemented by a processor including a CPU and an internal memory. The CPU executes a program stored in the internal memory to implement various functions of the machine guidance device 50.

The display device 40 displays images including various types of work information according to commands from the machine guidance device 50 included in the controller 30. The display device 40 is, for example, an on-board liquid crystal display connected to the machine guidance device 50.

The audio output device 43 outputs various types of audio information according to audio output commands from the machine guidance device 50 included in the controller 30. The audio output device 43 includes, for example, an on-board speaker connected to the machine guidance device 50. The audio output device 43 may also include an alarm such as a buzzer.

The input device 45 is used by the operator of the shovel PS to input various types of information to the controller 30 including the machine guidance device 50. The input device 45 includes, for example, a membrane switch provided on the surface of the display device 40. The input device 45 may also include a touch panel.

The storage device 47 stores various types of information. The storage device 47 is, for example, a non-volatile storage medium such as a semiconductor memory. The storage device 47 stores various types of information output from, for example, the controller 30 including the machine guidance device 50.

A gate lock lever 49 is a mechanism provided between a door of the cabin 10 and a cab seat to prevent the shovel PS from being mistakenly operated. The controller 30 controls a gate lock valve 49*a* (see FIG. 2) to be in a "closed" state when the gate lock lever 49 is in a lower position and controls the gate lock valve 49*a* to be in an "open" state when the gate lock lever 49 is in an upper position. The gate lock valve 49*a* is a switching valve provided in a hydraulic path between a control valve 17 and operation levers 26A-26C (see FIG. 2). The gate lock valve 49*a* is configured to open and close according to commands from the controller 30. However, the gate lock valve 49*a* may be mechanically connected to the gate lock lever 49 and configured to open and close according to operations of the gate lock lever 49.

In the "closed" state, the gate lock valve 49*a* blocks the flow of hydraulic oil between the control valve 17 and the operation levers 26A-26C to disable operations of the operation levers 26A-26C. In the "open" state, the gate lock valve 49*a* allows the hydraulic oil to flow between the control valve 17 and the operation levers 26A-26C to enable operations of the operation levers 26A-26C. That is, when an operator sits in the cab seat and pulls up the gate lock lever 49, the operator becomes unable to exit the cabin 10, and various operation devices become operable (unlocked state). When the operator presses down the gate lock lever 49, the operator is enabled to exit the cabin 10, and the various operation devices become inoperable (locked state).

Figure 2:
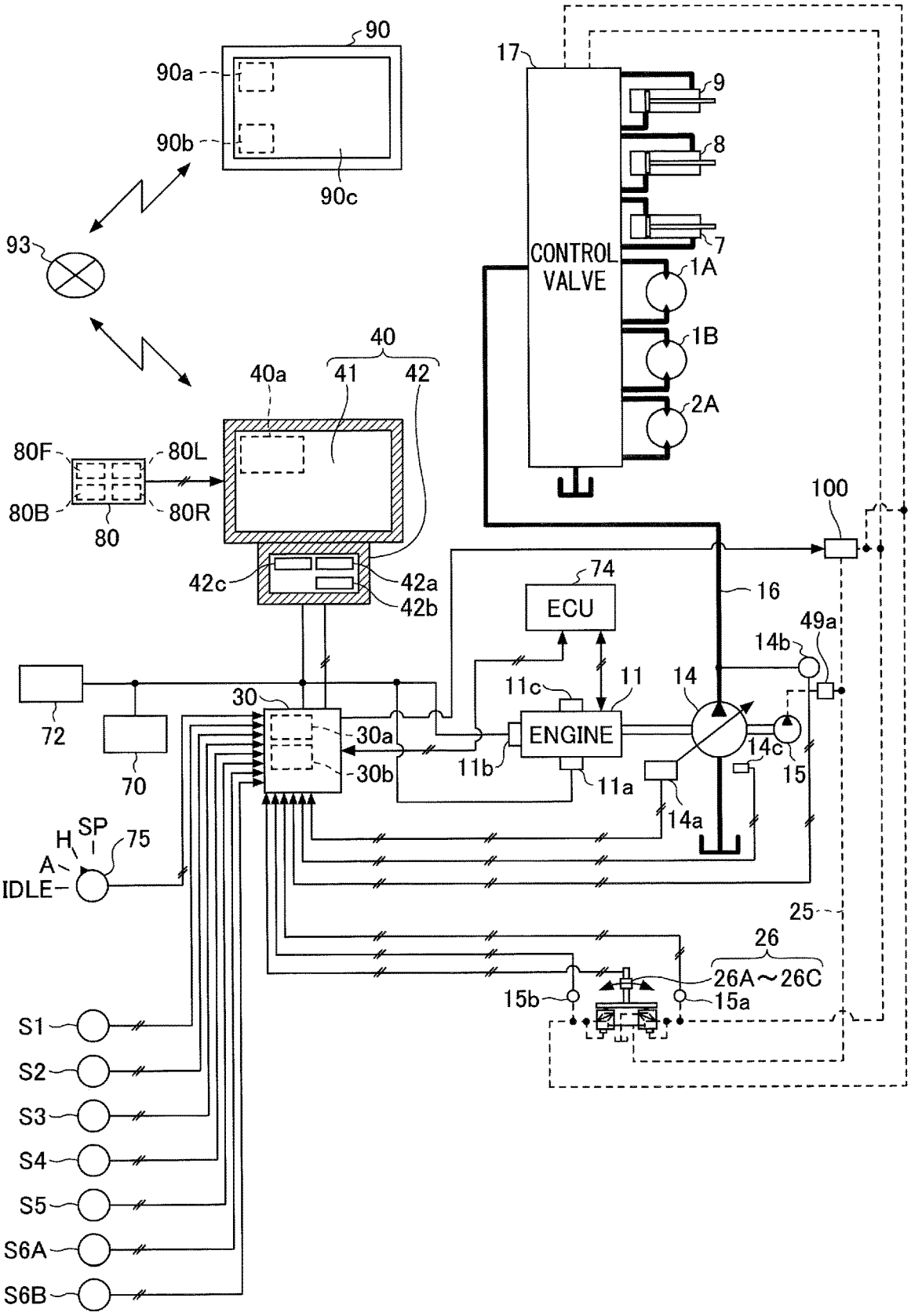
FIG. 2 is a block diagram illustrating an example of a configuration of a driving system of the shovel of FIG. 1.

FIG. 2 is a block diagram illustrating an example of a configuration of a driving system of the shovel PS of FIG. 1.

The driving system of the shovel PS includes the engine 11, a main pump 14, a pilot pump 15, the control valve 17, an operation device 26, the controller 30, an engine controller (ECU) 74, an engine speed adjustment dial 75, and operation valves 100.

The engine 11 is a driving source of the shovel PS. For example, the engine 11 is a diesel engine that operates to keep a predetermined speed. The output shaft of the engine 11 is connected to the input shafts of the main pump 14 and the pilot pump 15.

The main pump 14 is a hydraulic pump that supplies hydraulic oil via a high-pressure hydraulic line 16 to the control valve 17 and is, for example, a swash plate variable displacement hydraulic pump.

The pilot pump 15 is a hydraulic pump that supplies hydraulic oil via pilot lines 25 to various hydraulic control devices and is, for example, a fixed displacement hydraulic pump.

The control valve 17 is a hydraulic control valve for controlling the hydraulic system of the shovel PS. For example, the control valve 17 selectively supplies hydraulic oil supplied from the main pump 14 to one or more of the boom cylinder 7, the arm cylinder 8, the bucket cylinder 9, a traveling hydraulic motor (right) 1A, a traveling hydraulic motor (left) 1B, and a rotating hydraulic motor 2A. In the descriptions below, the boom cylinder 7, the arm cylinder 8, the bucket cylinder 9, the traveling hydraulic motor (right) 1A, the traveling hydraulic motor (left) 1B, and the rotating hydraulic motor 2A are collectively referred to as "hydraulic actuators".

The operation device 26 is used by the operator to operate the hydraulic actuators, and supplies hydraulic oil supplied from the pilot pump 15 via the pilot lines 25 to the pilot ports of flow control valves corresponding to the hydraulic actuators. The pressure of the hydraulic oil supplied to each of the pilot ports corresponds to the operation direction and the operation amount of one of the operation levers 26A-26C corresponding to one of the hydraulic actuators.

The controller 30 is a control device for controlling the shovel PS, and is implemented by a computer including, for example, a CPU, a RAM, and a ROM. The CPU of the controller 30 reads programs corresponding to operations and functions of the shovel PS from the ROM, loads the programs into the RAM, and executes the loaded programs to perform processes corresponding to the programs.

ECU 74 is a device for controlling the engine 11. For example, based on a command from the controller 30, the ECU 74 outputs to the engine 11 a fuel injection amount for controlling the speed of the engine 11 according to an engine speed (mode) set by the operator using the engine speed adjustment dial 75.

The engine speed adjustment dial 75 is used to adjust the engine speed. In the embodiment of the present invention, the engine speed adjustment dial 75 enables the operator to select the engine speed from four levels. For example, the engine speed adjustment dial 75 enables the operator to select the engine speed from four levels including an SP mode, an H mode, an A mode, and an IDLE mode. In FIG. 2, the H mode is selected with the engine speed adjustment dial 75.

The SP mode is an operation mode that is selected when the amount of work is prioritized, and uses the highest engine speed. The H mode is an operation mode that is selected to satisfy both the amount of work and the fuel efficiency, and uses the second highest engine speed. The A mode is an operation mode that is selected to drive the shovel PS with low noise while prioritizing fuel efficiency, and uses the third highest engine speed. The IDLE mode is an operation mode that is selected to place the engine in an idling state, and uses the lowest engine speed. The engine 11 is controlled to rotate at a constant engine speed corresponding to the operation mode that is set using the engine speed adjustment dial 75.

The operation valves 100 are used by the controller 30 to operate the hydraulic actuators. The operation valves 100 supply hydraulic oil supplied from the pilot pump 15 via the pilot lines 25 to the pilot ports of the flow control valves corresponding to the hydraulic actuators. The pressure of the hydraulic oil supplied to each of the pilot ports corresponds to a control signal from the controller 30. Depending on preset operations, the operation valve 100 is provided on at least one of the rod side and the bottom side of each of the cylinders of the boom 4, the arm 5, and the bucket 6 constituting an attachment. The operation valve 100 may be provided on each of the rod side and the bottom side. Also, the operation valve 100 is provided on at least one of the outlet side and the inlet side of each of the traveling hydraulic motor (right) 1A, the traveling hydraulic motor (left) 1B, and the rotating hydraulic motor 2A. The operation valve 100 may be provided on each of the outlet side and the inlet side. In this case, a preset operation can be performed even when the operation device 26 is in the neutral position. Further, a pressure reducing valve disposed between the operation device 26 and the control valve 17 may be used as the operation valve 100. In this case, a stable operation command can be given to the control valve 17 by sending a pressure reducing command from the controller 30 to the pressure reducing valve while the operation device 26 is fully pressed down.

The shovel PS also includes the display device 40.

The display device 40 is connected to the controller 30 via a communication network such as a Controller Area Network (CAN) or a Local Interconnect Network (LIN). Also, the display device 40 may be connected to the controller 30 via a dedicated line.

The display device 40 includes a conversion processor 40*a* for generating an image to be displayed on an image display 41. The conversion processor 40*a* generates a camera image to be displayed on the image display 41 based on an output from the imaging apparatus 80. Therefore, the imaging apparatus 80 is connected via, for example, a dedicated line to the display device 40. The conversion processor 40*a* also generates an image to be displayed on the image display 41 based on an output from the controller 30.

The imaging apparatus 80 includes the front monitoring camera 80F, the left-side monitoring camera 80L, the rear monitoring camera 80B, and the right-side monitoring camera 80R. The front monitoring camera 80F is provided on the front side of the cabin 10, e.g., on the ceiling of the cabin 10, and captures images of a scene in front of the shovel PS and operations of the boom 4, the arm 5, and the bucket 6. The left-side monitoring camera 80L is provided, for example, on the left-side of the upper surface of the cover 3*a* of the upper rotating body 3 and captures an image of a scene to the left of the shovel PS. The rear monitoring camera 80B is provided on the rear side of the upper rotating body 3, for example, on the rear side of the upper surface of the cover 3*a* of the upper rotating body 3, and captures an image of a scene behind the shovel PS. The right-side monitoring camera 80R is provided, for example, on the right-side of the upper surface the cover 3*a* of the upper rotating body 3, and captures an image of a scene to the right of the shovel PS. Each of the front monitoring camera 80F, the left-side monitoring camera 80L, the rear monitoring camera 80B, and the right-side monitoring camera 80R is, for example, a digital camera including an imaging device such as a CCD or a CMOS, and transmits a captured image to the display device 40 provided in the cabin 10.

The conversion processor 40*a* may be implemented as a function of the controller 30 rather than a function of the display device 40. In this case, the imaging apparatus 80 is connected to the controller 30 instead of the display device 40.

The display device 40 also includes a switch panel as an input unit 42. The switch panel is a panel that includes various hardware switches. For example, the switch panel includes a light switch 42*a*, a wiper switch 42*b*, and a window washer switch 42*c* that are implemented as hardware buttons. The light switch 42*a* is used to turn on and off a light attached to the outside of the cabin 10. The wiper switch 42*b* is used to start and stop a wiper. The window washer switch 42*c* is used to discharge a window washer liquid.

The display device 40 is driven by power supplied from a battery 70. The battery 70 is charged by power generated by an alternator 11*a* (generator) of the engine 11. The power of the battery 70 is also supplied to an electrical component 72 of the shovel PS other than the controller 30 and the display device 40. A starter 11*b* of the engine 11 is also driven by power supplied from the battery 70 to start the engine 11.

The engine 11 is controlled by the ECU 74. The ECU 74 constantly transmits, to the controller 30, various types of data (e.g., data indicating a cooling water temperature detected by a water temperature sensor 11*c*) indicating states of the engine 11. Accordingly, the controller 30 can store the data in a temporary storage 30*a* and transmit the data to the display device 40 when needed.

As described below, various types of data are supplied to the controller 30 and stored in the temporary storage 30*a* of the controller 30. The stored data can be transmitted to the display device 40 when needed.

First, a regulator 14*a* of the main pump 14, which is a variable displacement hydraulic pump, transmits data indicating a swash plate angle to the controller 30. Also, a discharge pressure sensor 14*b* transmits data indicating a discharge pressure of the main pump 14 to the controller 30. An oil temperature sensor 14*c* is provided in a pipe line between the main pump 14 and a tank containing hydraulic oil that is taken in by the main pump 14, and the oil temperature sensor 14*c* transmits data indicating the temperature of the hydraulic oil flowing through the pipe line to the controller 30.

Oil pressure sensors 15*a* and 15*b* detect pilot pressures fed to the control valve 17 when the operation levers 26A-26C are operated, and transmit data indicating the detected pilot pressures to the controller 30.

Further, the engine speed adjustment dial 75 constantly transmits data indicating the set engine speed to the controller 30.

The shovel PS can communicate with the management apparatus 90 via a communication network 93.

The management apparatus 90 is, for example, a computer installed in the manufacturer of the shovel PS or a service center, and enables specialized staff (e.g., a designer) to remotely monitor the state of the shovel PS. The controller 30 can store data indicating values detected by various state detecting sensors included in the shovel PS in, for example, the temporary storage 30*a* and transmit the stored data to the management apparatus 90. The controller 30 may include a radio communication function and may be capable of communicating with the management apparatus 90 via the communication network 93. The data indicating the values detected by the state detecting sensors is transmitted from the shovel PS to the management apparatus 90, and is received by a receiver 90*a* of the management apparatus 90. Then, the specialized staff analyzes the received data, and determines the state of the shovel PS. For example, the specialized staff may determine whether a failure or a malfunction exists; and if a failure or a malfunction exists, identify the location and the cause of the failure or the malfunction. This in turn enables the specialized staff to bring, for example, parts necessary to repair the shovel PS in advance, and thereby reduce the time necessary for the maintenance or repair.

The management apparatus 90 includes a processor 90*b*. The processor 90*b* may process the values detected by the state detecting sensors and transmitted from the shovel PS according to a predetermined program input beforehand. For example, the processor 90*b* may include a diagnostic program that has been input and may perform failure diagnosis or failure prediction using the detection values transmitted from the shovel PS according to the diagnostic program. The processing results of the processor 90*b* may be displayed on a display 90*c* of the management apparatus 90.

The management apparatus 90 may be configured to be able to indirectly communicate with the shovel PS via, for example, a server provided in the manufacturer of the shovel PS or a service center. The management apparatus 90 may be a computer permanently installed in the manufacturer or the service center, or a portable computer that the specialized staff can carry. The portable computer may be, for example, a multifunction mobile information terminal or a mobile terminal such as a smartphone or a tablet terminal. When the management apparatus 90 is a portable computer, the specialized staff can bring the management apparatus 90 to an inspection or repair site, and perform inspection or repair work by referring to a display (display 90*c*) of the management apparatus 90. This in turn makes it possible to improve the efficiency of inspection and repair work. Also, when the management apparatus 90 is a mobile terminal, the management apparatus 90 may be configured to directly communicate with the shovel using a near field communication technology such as Bluetooth (registered trademark) or infrared communication without using a communication network. In this case, the specialized staff can transmit a command to execute a preset operation from the mobile terminal to the shovel by entering the command on the screen of the mobile terminal or via a voice input. That is, a command is transmitted from the mobile terminal to the shovel to cause the shovel to store values detected by the state detecting sensors during the execution of the preset operation in association with the preset operation. Then, the shovel transmits the results of the preset operation to the mobile terminal so that the results of the preset operation can be confirmed on a screen of the mobile terminal.

The state detecting sensors included in the shovel PS are sensors that detect the operating states of respective components of the shovel PS. For example, the state detecting sensors include the boom angle sensor S1, the arm angle sensor S2, the bucket angle sensor S3, the body tilt sensor S4, a rotation angle sensor S5, a traveling rotation sensor (right) S6A, and a traveling rotation sensor (left) S6B.

The boom angle sensor S1 is provided on a support (joint) of the boom 4 joined to the upper rotating body 3, and detects an angle (boom angle) of the boom 4 with respect to a horizontal plane. The boom angle sensor S1 may be implemented by any angle sensor such as a rotary potentiometer. This also applies to the arm angle sensor S2 and the bucket angle sensor S3 described later. The detected boom angle is transmitted to the controller 30.

The arm angle sensor S2 is provided on a support (joint) of the arm 5 joined to the boom 4, and detects an angle (arm angle) of the arm 5 with respect to the boom 4. The detected arm angle is transmitted to the controller 30.

The bucket angle sensor S3 is provided on a support (joint) of the bucket 6 joined to the arm 5, and detects an angle (bucket angle) of the bucket 6 with respect to the arm 5. The detected bucket angle is transmitted to the controller 30.

The body tilt sensor S4 detects tilt angles of the shovel PS with respect to a horizontal plane in two axial directions (longitudinal direction and lateral direction). The body tilt sensor S4 may be implemented by any tilt sensor such as a liquid-encapsulated capacitive tilt sensor. The detected tilt angles are transmitted to the controller 30.

The rotation angle sensor S5 detects a rotation angle of the upper rotating body 3 rotated by the rotation mechanism 2. The rotation angle sensor S5 may be implemented by any angle sensor such as a rotary encoder. The detected rotation angle is transmitted to the controller 30.

The traveling rotation sensor (right) S6A and the traveling rotation sensor (left) S6B detect the rotation speeds of the traveling hydraulic motor (right) 1A and the traveling hydraulic motor (left) 1B, respectively. Each of the traveling rotation sensor (right) S6A and the traveling rotation sensor (left) S6B may be implemented by any rotation sensor such as a magnetic rotation sensor. The detected rotation speeds are transmitted to the controller 30.

As described above, the state detecting sensors in the shovel PS also include the water temperature sensor 11*c*, the regulator 14*a*, the discharge pressure sensor 14*b*, the oil temperature sensor 14*c*, the oil pressure sensors 15*a* and 15*b*, the engine speed adjustment dial 75, and the imaging apparatus 80. Values detected by these sensors are also transmitted to the controller 30.

The data transmitted from the state detecting sensors in the shovel PS to the controller 30 is stored in the temporary storage 30*a* of the controller 30.

Here, when the detection values of the state detecting sensors transmitted from the shovel PS are analyzed by the management apparatus 90, there may be a case where the operating conditions under which the detection values are detected are not known. Also, even if the values have been detected under predetermined operating conditions and transmitted, the reliability of whether the values have been actually detected under the predetermined operating conditions may be low. Further, values, detected under the same predetermined operating conditions may still vary due to, for example, the differences in the skill of operators. These problems may increase the time necessary for the analysis, may result in ineffective analysis results, and may require the specialized staff to go to the actual site to measure values again.

For the above reasons, according to the embodiment of the present invention, to obtain data to be transmitted to the management apparatus 90, a preset operation is executed under the control of the controller instead of requiring the operator to operate the operation device 26. Values detected by the state detecting sensors during the preset operation are associated with the preset operation and transmitted to the management apparatus 90. This eliminates the need for the operator to operate the operation device 26. Accordingly, the above embodiment makes it possible to reduce the burden of operators and reduce operational variations resulting from the differences in the skill of the operators. This in turn makes it possible to obtain reliable data.

Figure 3:
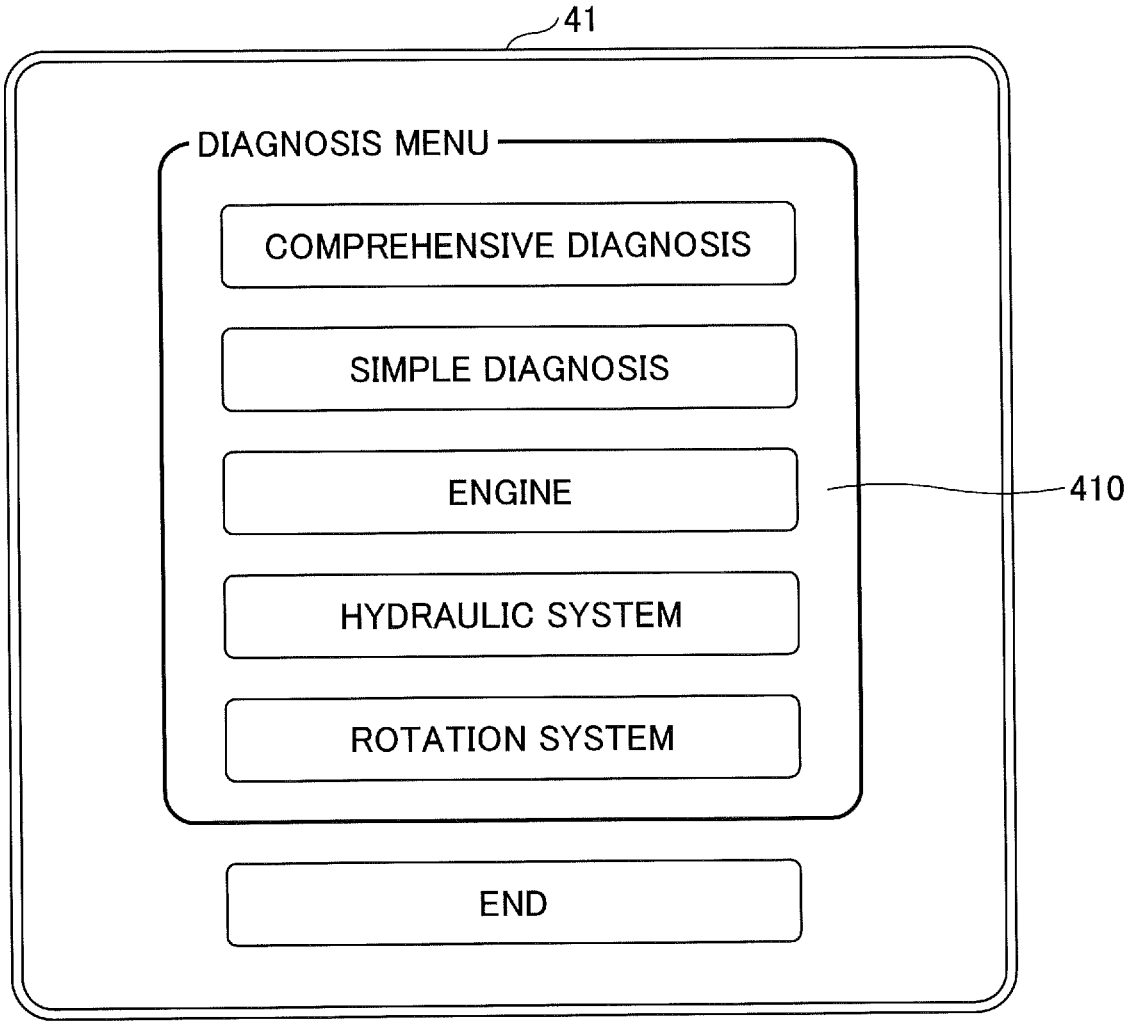
FIG. 3 is a drawing illustrating an example of a diagnosis menu selection screen displayed on an image display.

FIG. 3 is a drawing illustrating an example of a diagnosis menu selection screen displayed on the image display 41.

As illustrated in FIG. 3, the diagnosis menu selection screen includes a diagnosis menu display 410. An image displayed on the diagnosis menu display 410 is generated by the conversion processor 40*a* of the display device 40 based on various data transmitted from the controller 30.

The diagnosis menu display 410 displays multiple diagnosis menu items corresponding to portions to be diagnosed. In the example of FIG. 3, the diagnosis menu display 410 displays five diagnosis menu items including "Comprehensive Diagnosis", "Simple Diagnosis", "Engine", "Hydraulic System", and "Rotation System". The diagnosis menu items are stored in, for example, the ROM of the controller 30 in advance. Each of the diagnosis menu items may include one or more preset operations. The image display 41 also displays a menu item "End" that is used to end the display of the diagnosis menu. The operator can select a diagnosis menu item to be executed by touching the diagnosis menu item in the diagnosis menu selection screen displayed on the image display 41. Instead of a touch operation, a diagnosis menu item may also be selected through a button operation.

"Comprehensive Diagnosis" is a diagnosis menu item for comprehensively diagnosing whether components of the shovel PS are functioning normally and includes, for example, an engine preset operation(s), a hydraulic system preset operation(s), and a rotation mechanism preset operation(s). When the operator selects "Comprehensive Diagnosis", the controller 30 executes the engine preset operations, the hydraulic system preset operations, and the rotation mechanism preset operations. "Comprehensive Diagnosis" may include other preset operations instead of or in addition to the above-described preset operations (the engine preset operations, the hydraulic system preset operations, and the rotation mechanism preset operations).

"Simple Diagnosis" is a diagnosis menu item that simply diagnoses whether components of the shovel PS are functioning normally. For example, "Simple Diagnosis" includes a part of the engine preset operations and a part of the hydraulic system preset operations, and does not include operations of the attachment of the shovel PS and rotational operations. When the operator selects "Simple Diagnosis", the controller 30 executes a part of the engine preset operations and a part of the hydraulic system preset operations of the shovel PS. The "Simple Diagnosis" may include other preset operations instead of or in addition to the above-described preset operations (a part of the engine preset operations and a part of the hydraulic system preset operations).

"Engine" is a diagnosis menu item that includes one or more preset operations for diagnosing whether the engine 11 is functioning normally. When the operator selects "Engine", the controller 30 executes the engine preset operations related to the engine of the shovel PS.

"Hydraulic System" is a diagnosis menu item that includes one or more preset operations for diagnosing whether the hydraulic system is functioning normally. For example, "Hydraulic System" includes one or more preset operations for diagnosing hydraulic pumps such as the main pump 14 and the pilot pump 15 and the hydraulic actuators. "Hydraulic System" may include, for example, a preset operation α "close the arm up to the stroke end (arm closing operation)" and a preset operation β "raise the boom up to the stroke end with the arm closed (boom raising operation)". "Hydraulic System" may include other preset operations instead of or in addition to the above-described preset operations (preset operations α and β. Here, exemplary preset operations for the attachment including the boom 4 and the arm 5 are described. First, the controller 30 outputs a command to the operation valve 100 to rotate the boom 4 up to the stroke end in the boom raising operation. Then, the controller 30 continuously applies a load to the boom 4. That is, the controller 30 controls the control valve 17 such that hydraulic oil continuously flows to the boom cylinder 7. In this state, because the boom 4 is at the stroke end, the hydraulic oil is discharged from a relief valve into a tank. Thus, it is possible to continuously apply a load to the boom 4 by rotating the boom 4 up to the stroke end of the cylinder. This makes it possible to obtain diagnostic data in a reproducible and stable state in any working environment. The same applies to the arm 5 and the bucket 6. Further, after the boom 4 reaches the stroke end of the cylinder, the load may be varied by adjusting the regulator 14*a* of the main pump 14 or by changing the engine speed. Detecting a change in the cylinder pressure of an attachment such as the boom 4 or a change in the discharge pressure of the main pump 14 when the load is varied makes it possible to reproduce a dynamic state and further improve the accuracy of diagnosis. Thus, this method makes it possible to diagnose even the main pump 14 and the engine 11 in addition to hydraulic circuits.

"Rotation System" is a diagnosis menu item including one or more preset operations for diagnosing whether the rotation mechanism 2 (the rotating hydraulic motor 2A, a rotation speed reducer, etc.) is functioning normally. "Rotation System" includes, for example, a preset operation "rotate with the attachment closed (rotation operation)" as a preset operation. "Rotation System" may include other preset operations instead of or in addition to the above preset operation (the rotation operation as a preset operation). Here, an example of a preset operation such as rotating or traveling for a drive mechanism using a hydraulic motor is described. First, the controller 30 outputs a command to the operation valve 100 to set an attachment such as the boom in a predetermined attitude. This is because, particularly in the diagnosis of the rotation system, the rotation load is greatly influenced by the rotational moment of inertia that is based on the change in the attitude of the attachment. Therefore, the controller 30 drives the boom 4, the arm 5, and the bucket 6 such that the attachment is set in the predetermined attitude. Also, when a heavy end attachment such as a breaker is attached to the arm 5, the controller 30 may ask the operator to change the end attachment to a normal bucket 6. In this way, the attachment is adjusted before driving the rotation drive mechanism so that the moment of inertia generated during the rotation becomes constant. After the adjustment, the controller 30 outputs predetermined drive commands to the operation valve 100 to execute the rotation operation. Based on the drive commands for driving the rotating hydraulic motor 2A to accelerate, rotate at a constant speed, and decelerate, the rotating hydraulic motor 2A can perform the rotation preset operation. Through the above process, diagnosis of the rotating hydraulic motor 2A, the hydraulic circuit for the rotating hydraulic motor 2A, and the rotation speed reducer can be performed. For example, if a failure occurs in the relief valve of the hydraulic circuit, the rotation acceleration is reduced.

Such a failure can be detected based on a change in the pressure detection value of the hydraulic circuit of the rotating hydraulic motor 2A.

Figure 4:
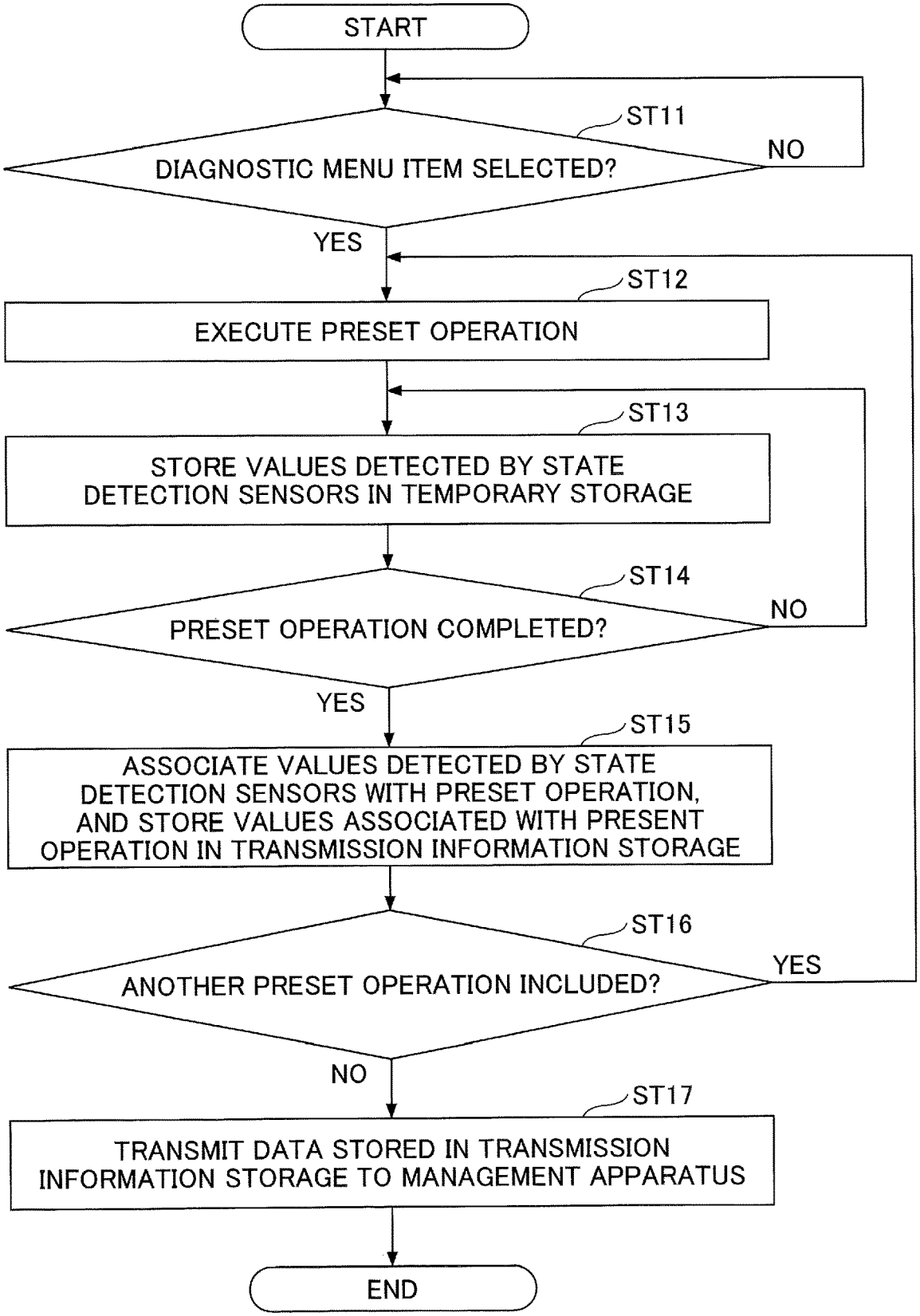
FIG. 4 is a flowchart illustrating an example of a process for obtaining data used for analysis at a management apparatus.

Next, an example of a process where the shovel PS of the present embodiment obtains data used for analysis at the management apparatus 90 is described with reference to FIG. 4. FIG. 4 is a flowchart illustrating an example of a process for obtaining data used for analysis at the management apparatus 90.

First, the controller 30 determines whether a diagnosis menu item has been selected by the operator (step ST11). For example, the operator selects a diagnosis menu item to be executed by touching the diagnosis menu item in the diagnosis menu displayed on the diagnosis menu display 410. In this example, it is assumed that "Hydraulic System" is selected as the diagnosis menu item. "Hydraulic System" includes an "arm closing operation" as a preset operation α and a "boom raising operation" as a preset operation β.

When the diagnosis menu item is selected by the operator at step ST11, the controller 30 sounds an alarm to alert the surrounding people and executes the preset operations according to instructions in the diagnosis menu item selected at step ST11 (step ST12). In this example, because "Hydraulic System" is selected, the controller 30 executes the preset operation α included in "Hydraulic System". First, the controller 30 calculates the current attitude of the shovel PS based on detection values transmitted from the boom angle sensor S1, the arm angle sensor S2, and the bucket angle sensor S3. Next, the controller 30 controls the operation valves 100 such that the calculated attitude of the shovel PS matches an initial position (initial attitude) for the preset operation α (initial operation). After the attitude of the shovel PS matches the initial attitude for the preset operation α, the controller 30 controls the operation valves 100 to execute the preset operation α. For safety, the controller 30 is preferably configured to cause the shovel PS to perform the preset operation when the gate lock lever 49 is in the unlocked state.

Along with the execution of the preset operation at step ST12, detection values detected by various state detecting sensors during the execution of the preset operation are stored in the temporary storage 30*a* (step ST13). For example, the detection values of the state detecting sensors may be detected at every predetermined sampling period, transmitted to the controller 30, and stored in the temporary storage 30*a*.

Next, the controller 30 determines whether the preset operation has been completed (step ST14). The controller 30 determines whether the preset operation has been completed based on data indicating the detection values that are obtained from sensors such as the boom angle sensor S1, the arm angle sensor S2, the bucket angle sensor S3, and the body tilt sensor S4 and stored in the temporary storage 30*a* at step ST13.

When it is determined at step ST14 that the preset operation has not been completed, the process returns to step ST13, and the controller 30 continues to store detection values detected by the state detecting sensors during the execution of the preset operation in the temporary storage 30*a*.

When it is determined at step ST14 that the preset operation has been completed, the controller 30 associates the detection values detected by the state detecting sensors during the execution of the preset operation with information on the preset operation, and stores the detection values associated with the preset operation in a transmission information storage 30*b* (step ST15). In this example, the preset operation α is associated with the detection values that are detected by the state detecting sensors during the execution of the preset operation α and stored in the temporary storage 30*a*, and data indicating the detection values associated with the preset operation α is stored in the transmission information storage 30*b*.

Next, the controller 30 determines whether the selected diagnosis menu item includes another preset operation (step ST16). In this example, because the selected diagnosis menu item includes the preset operation β in addition to the preset operation α, the process returns to step ST12, and steps ST12 through ST15 are executed for the preset operation β. When the initial position for the preset operation β is the same as the end position in the preset operation α, it is not necessary to control the operation valves 100 to adjust the attitude of the shovel PS to match the initial attitude for the preset operation β.

Similarly to the preset operation α, along with the execution of the preset operation (the preset operation β) at step ST12, detection values detected by the state detecting sensors during the execution of the preset operation are stored in the temporary storage 30*a* (step ST13). The controller 30 determines whether the preset operation has been completed (step ST14). When it is determined that the preset operation has been completed, the controller 30 associates the detection values detected by the state detecting sensors during the execution of the preset operation with information on the preset operation, and stores the detection values associated with the preset operation in the transmission information storage 30*b* (step ST15). In this example, the preset operation β is associated with the detection values that are detected by the state detecting sensors during the execution of the preset operation β and stored in the temporary storage 30*a*, and data indicating the detection values associated with the preset operation β is stored in the transmission information storage 30*b*.

Next, the controller 30 determines whether the selected diagnosis menu item includes another preset operation (step ST16). In this example, because the selected diagnosis menu item "Hydraulic System" includes no preset operation other than the preset operations α and β, the process proceeds to step ST17.

At step ST17, the controller 30 displays, on the display device 40, information indicating that the measurement has been completed and measurement data is to be transmitted; and then transmits, to the management apparatus 90, the data that is stored in the transmission information storage 30*b* and includes the detection values of the state detecting sensors associated with the information on the preset operations. In this example, the controller 30 transmits the detection values that are associated with the preset operation α and detected by the state detecting sensors during the execution of the preset operation α, and the detection values that are associated with the preset operation β and detected by the state detecting sensors during the execution of the preset operation β.

Then, the process for obtaining data used for analysis at the management apparatus 90 ends.

In the example of FIG. 4, the data transmitted to the management apparatus 90 is associated with each of the preset operations (the preset operations α and β). This enables the specialized staff (e.g., a designer) at the management apparatus 90 to easily recognize the assumption for analysis, i.e., operational conditions under which the data has been obtained, and makes it possible to reduce analysis time for determining the states of the shovel PS and to efficiently perform the analysis. Also, because the analysis is performed based on data whose operational conditions are known, it is possible to make effective judgments on the states of the shovel PS (e.g., presence/absence of a failure or malfunction, the degree of the failure or malfunction, the location of the failure or malfunction, the cause of the failure or malfunction, etc.) based on the analysis results. A diagnostic program for the shovel PS may be preinstalled in the management apparatus 90. In this case, the management apparatus 90 can perform failure diagnosis and failure prediction based on the detection values transmitted from the shovel PS.

In the example of FIG. 4, the controller 30 executes a preset operation to obtain data to be transmitted to the management apparatus 90. Also, detection values detected by sensors during the preset operation are associated with the preset operation and transmitted to the management apparatus 90. This eliminates the need for the operator to operate the operation device 26. Thus, the present embodiment makes it possible to reduce the burden of operators and reduce operational variations resulting from the differences in the skill of the operators. This in turn makes it possible to obtain highly-reliable data, to perform reliable analysis based on the data, and to make effective judgments on the states of the shovel PS.

Figure 5:
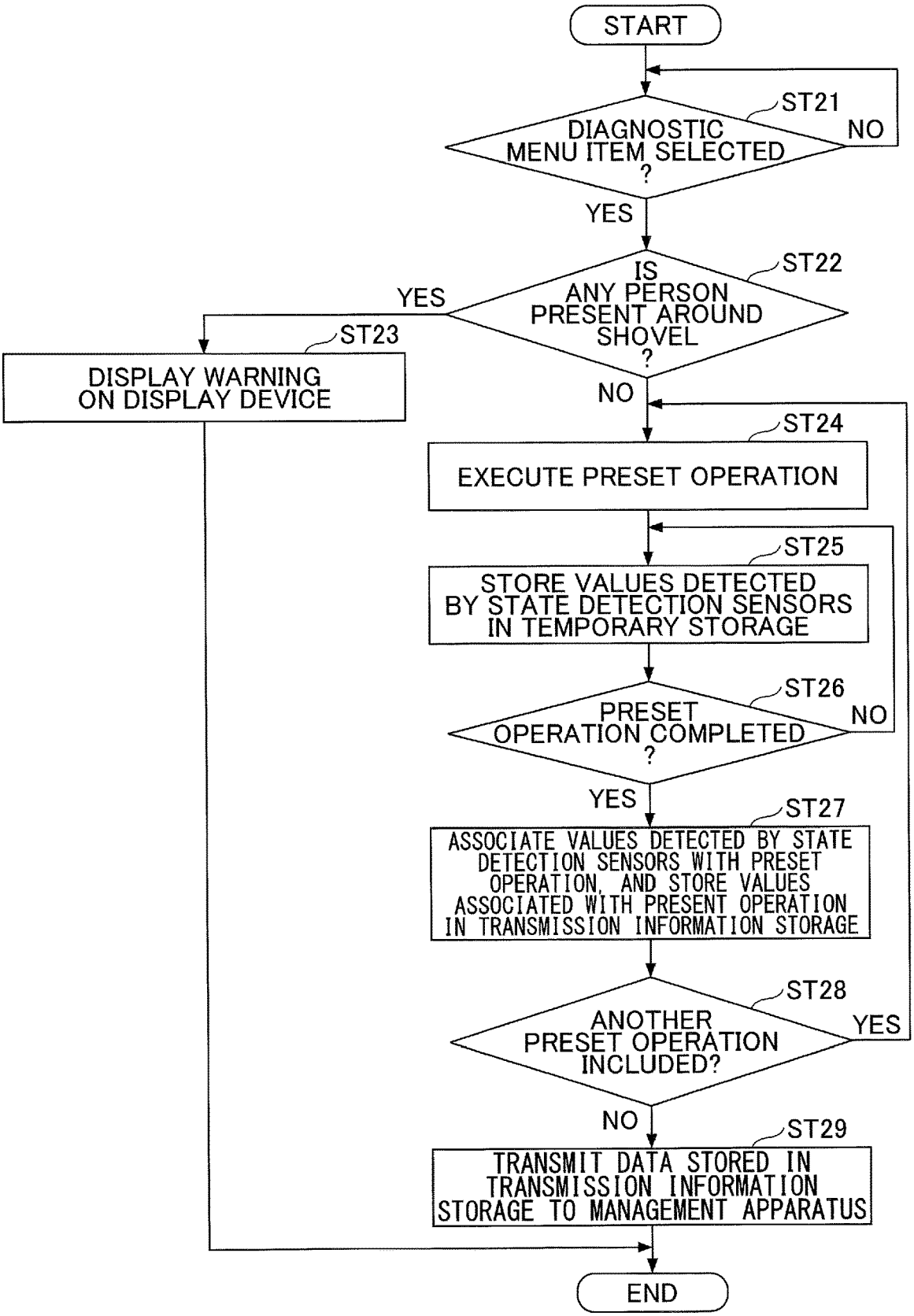
FIG. 5 is a flowchart illustrating another example of a process for obtaining data used for analysis by the management apparatus.

Next, another example of a process where the shovel PS of the present embodiment obtains data used for analysis at the management apparatus 90 is described with reference to FIG. 5. FIG. 5 is a flowchart illustrating another example of a process for obtaining data used for analysis at the management apparatus 90.

The example of FIG. 5 differs from the example of FIG. 4 in that if, for example, a person exists around the shovel PS when a diagnosis menu item is selected, the process for obtaining data used for analysis at the management apparatus 90 is terminated without executing any preset operation. Below, differences from the example of FIG. 4 are mainly described.

First, the controller 30 determines whether a diagnosis menu item has been selected by the operator (step ST21). For example, the operator selects a diagnosis menu item to be executed by touching the diagnosis menu item in the diagnosis menu displayed on the diagnosis menu display 410. In this example, it is assumed that "Hydraulic System" is selected as the diagnosis menu item. "Hydraulic System" includes an "arm closing operation" as a preset operation α and a "boom raising operation" as a preset operation β.

When the diagnosis menu item is selected by the operator at step ST21, the controller 30 determines whether, for example, a person exists around the shovel PS (step ST22). Specifically, the controller 30 determines whether a person exists around the shovel PS based on images captured by the imaging apparatus 80 provided in the shovel PS. Also, various human body detecting sensors capable of detecting humans may be used to determine whether a person exists around the shovel PS.

When it is determined at step ST22 that a person exists around the shovel PS, the controller 30 displays, on the display device 40, a message indicating that a person exists around the shovel PS (step ST23). Then, the process is terminated.

When it is determined at step ST22 that no person exists around the shovel PS, the process proceeds to step ST24. Steps ST24 through ST29 may be substantially the same as steps ST12 through ST17 in the example of FIG. 4.

Then, the process for obtaining data used for analysis at the management apparatus 90 ends.

In the example of FIG. 5, in addition to the example of FIG. 4, if a person exists around the shovel PS, the controller 30 does not execute the preset operation even if a diagnosis menu item is selected by the operator. This improves safety.

Figure 6:
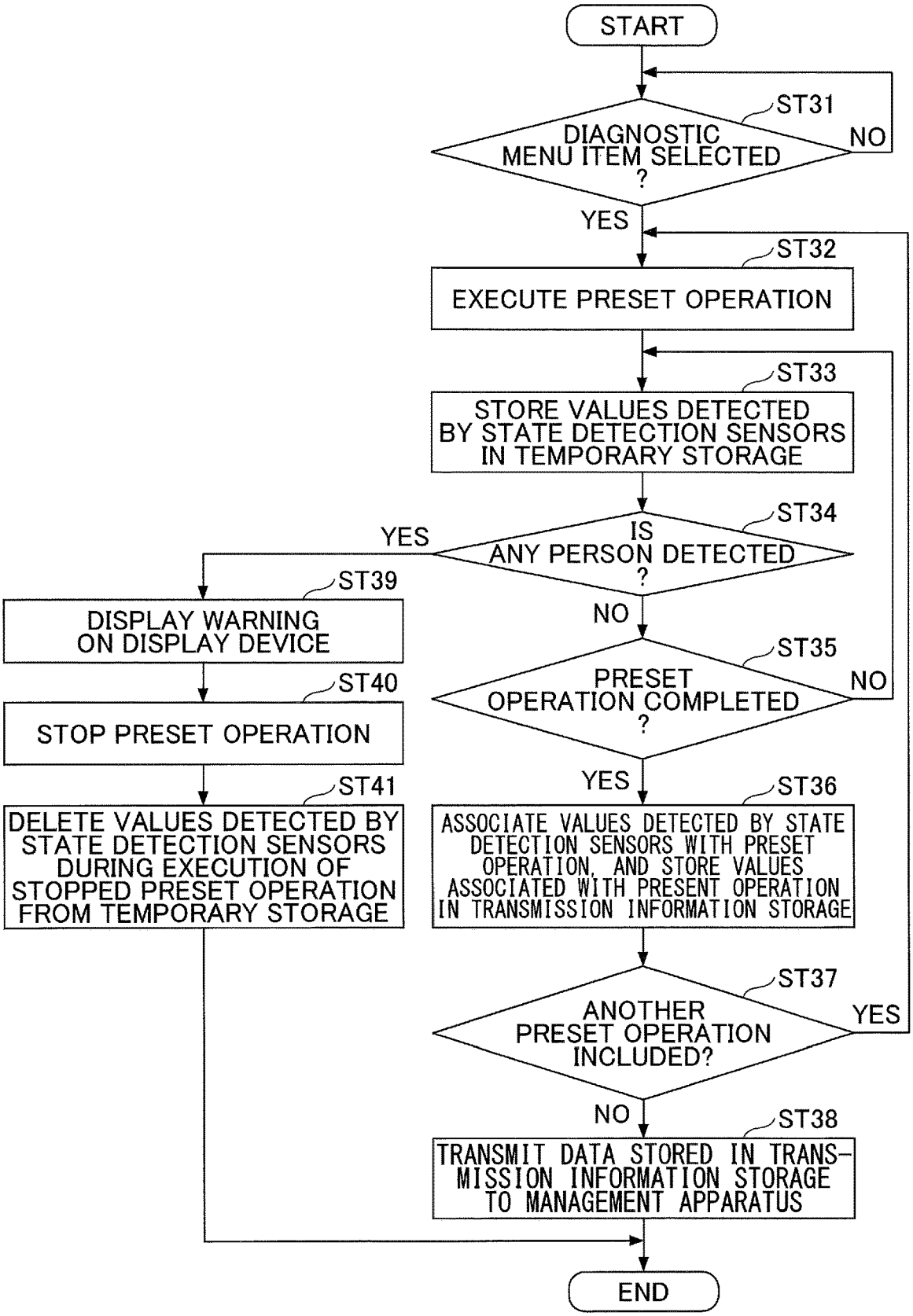
FIG. 6 is a flowchart illustrating still another example of a process for obtaining data used for analysis by the management apparatus.

Next, another example of a process where the shovel PS of the present embodiment obtains data used for analysis at the management apparatus 90 is described with reference to FIG. 6. FIG. 6 is a flowchart illustrating another example of a process for obtaining data used for analysis at the management apparatus 90.

The example of FIG. 6 differs from the example of FIG. 4 in that the process for obtaining data used for analysis at the management apparatus 90 is terminated in the middle when, for example, a person enters the area around the shovel PS during the execution of the preset operation. Below, differences from the example of FIG. 4 are mainly described.

First, the controller 30 determines whether a diagnosis menu item has been selected by the operator (step ST31). For example, the operator selects a diagnosis menu item to be executed by touching the diagnosis menu item in the diagnosis menu displayed on the diagnosis menu display 410. In this example, it is assumed that "Hydraulic System" is selected as the diagnosis menu item. "Hydraulic System" includes an "arm closing operation" as a preset operation α and a "boom raising operation" as a preset operation β.

When the diagnosis menu item is selected by the operator at step ST31, the controller 30 sounds an alarm to alert the surrounding people and executes the preset operations according to instructions in the diagnosis menu item selected at step ST31 (step ST32). In this example, because "Hydraulic System" is selected, the controller 30 executes the preset operation α included in "Hydraulic System". First, the controller 30 calculates the current attitude of the shovel PS based on detection values transmitted from the boom angle sensor S1, the arm angle sensor S2, and the bucket angle sensor S3. Next, the controller 30 controls the operation valves 100 such that the calculated attitude of the shovel PS matches an initial position (initial attitude) for the preset operation α (initial operation). After the attitude of the shovel PS matches the initial attitude for the preset operation α, the controller 30 controls the operation valves 100 to execute the preset operation α. Along with the execution of the preset operation at step ST32, detection values detected by various state detecting sensors during the execution of the preset operation are stored in the temporary storage 30*a* (step ST33). For example, the detection values of the state detecting sensors may be detected at every predetermined sampling period, transmitted to the controller 30, and stored in the temporary storage 30*a*.

Also, along with the execution of the preset operation at step ST32, the controller 30 determines whether, for example, a person exists around the shovel PS (step ST34). Specifically, the controller 30 determines whether a person exists around the shovel PS based on images captured by the imaging apparatus 80 provided in the shovel PS. Also, various human body detecting sensors capable of detecting humans may be used to determine whether a person exists around the shovel PS.

When it is determined at step ST34 that a person exists around the shovel PS, the controller 30 displays, on the display device 40, a message indicating that a person exists around the shovel PS (step ST39). Then, the controller 30 stops the preset operation (step ST40), and deletes detection values detected by the state detecting sensors during the stopped preset operation from the temporary storage 30*a* (step ST41). Then, the process is terminated. Before terminating the process, the controller 30 may display a screen for selecting whether to terminate or resume the process on the image display 41. In this case, if the resumption of the process is selected by the operator, the controller 30 resumes the process from the stopped preset operation in the selected diagnosis menu item. For example, if the process is stopped during the execution of the preset operation α, the controller 30 resumes the process from the preset operation α.

When it is determined at step ST34 that no person exists around the shovel PS, the process proceeds to step ST24. At step ST35, the controller 30 determines whether the preset operation has been completed (step ST35). The controller 30 determines whether the preset operation has been completed based on data indicating the detection values detected by the boom angle sensor S1, the arm angle sensor S2, the bucket angle sensor S3, and the body tilt sensor S4 and stored in the temporary storage 30*a* at step ST33.

When it is determined at step ST35 that the preset operation has not been completed, the process returns to step ST33 and stores detection values detected by the state detecting sensors during the execution of the preset operation in the temporary storage 30*a*. Then, the controller 30 determines again whether a person exists around the shovel PS (step ST34).

When it is determined at step ST35 that the preset operation has been completed, the controller 30 associates the detection values detected by the state detecting sensors during the execution of the preset operation with information on the preset operation, and stores the detection values associated with the preset operation in the transmission information storage 30*b* (step ST36). In this example, the detection values detected by the state detecting sensors and stored in the temporary storage 30*a* during the execution of the preset operation α are associated with the preset operation α, and data indicating the detection values associated with the preset operation α is stored in the transmission information storage 30*b*.

Next, the controller 30 determines whether the selected diagnosis menu item includes another preset operation (step ST37). In this example, because the selected diagnosis menu item includes the preset operation β in addition to the preset operation α, the process returns to step ST32, and steps ST32 through ST36 are executed for the preset operation β. When the initial position for the preset operation β is the same as the end position in the preset operation α, it is not necessary to control the operation valves 100 to adjust the attitude of the shovel PS to match the initial position (initial attitude) for the preset operation β.

Similarly to the preset operation α, along with the execution of the preset operation (the preset operation β) at step ST32, detection values detected by the state detecting sensors during the execution of the preset operation are stored in the temporary storage 30*a* (step ST33). Then, the controller 30 determines again whether a person exists around the shovel PS (step ST34). Also, when the execution of the preset operation (preset operation β) is completed, the controller 30 determines whether the preset operation has been completed (step ST35). When it is determined that the preset operation (preset operation β) has been completed, the controller 30 associates the detection values detected by the state detecting sensors during the execution of the preset operation with information on the preset operation, and stores the detection values associated with the preset operation in the transmission information storage 30*b* of the controller 30 (step ST36). In this example, the detection values detected by the state detecting sensors and stored in the temporary storage 30*a* during the execution of the preset operation β are associated with the preset operation β, and data indicating the detection values associated with the preset operation β is stored in the transmission information storage 30*b*.

Next, the controller 30 determines whether the selected diagnosis menu item includes another preset operation (step ST37). In this example, because the selected diagnosis menu item "Hydraulic System" includes no preset operation other than the preset operations α and β, the process proceeds to step ST38.

At step ST38, the controller 30 displays, on the display device 40, information indicating that the measurement has been completed and measurement data is to be transmitted; and then transmits, to the management apparatus 90, the data that is stored in the transmission information storage 30*b* and includes the detection values of the state detecting sensors associated with the information on the preset operations. In this example, the controller 30 transmits the detection values that are associated with the preset operation α and detected by the state detecting sensors during the execution of the preset operation α, and the detection values that are associated with the preset operation β and detected by the state detecting sensors during the execution of the preset operation β.

Then, the process for obtaining data used for analysis at the management apparatus 90 ends.

In the example of FIG. 6, in addition to the example of FIG. 4, the controller 30 stops the preset operation when, for example, a person enters the area around the shovel PS during the execution of the preset operation by the controller 30. This improves safety. The example of FIG. 5 and the example of FIG. 6 may be combined.

Embodiments of the present invention are described above. However, the present invention is not limited to the above-described embodiments, and variations and modifications may be made without departing from the scope of the present invention.

The above embodiments are described based on an example where the diagnosis menu item "Hydraulic System" including the preset operation α "arm closing operation" and the preset operation β "boom raising operation" is executed. However, the present invention is not limited to this example. For example, a preset operation may include an initial operation where the attitude of the shovel PS is set in an initial attitude before states of the shovel PS are detected by the state detecting sensors, a decision operation where whether the attitude of the shovel PS has been set in the initial attitude is determined, and a relief operation where the shovel PS is placed in a hydraulic relief state.

An aspect of this disclosure makes it possible to provide a shovel that can reduce the burden of an operator and operational variations.

What is claimed is:

1. A shovel, comprising:

a lower traveling body;

an upper rotating body that is rotatably mounted on the lower traveling body;

a rotation drive mechanism configured to rotate the upper rotating body relative to the lower traveling body;

an attachment attached to the upper rotating body, the attachment including a boom, an arm, and an end attachment;

state detecting sensors configured to detect operational states of components of the shovel and including an attitude sensor configured to detect an attitude of the attachment; and a hardware processor configured to execute a preset operation of at least one of the attachment and the rotation drive mechanism based on a detection value detected by the attitude sensor, associate detection values detected by the state detecting sensors during execution of the preset operation of the at least one of the attachment and the rotation drive mechanism with the present operation, and store the detection values associated with the preset operation in a storage.

2. The shovel as claimed in claim 1, wherein the hardware processor is configured to execute the preset operation while a gate lock lever is in an unlocked state.

3. The shovel as claimed in claim 1, wherein the preset operation includes an initial operation to set the attitude of the shovel in an initial attitude before the operational states are detected by the state detecting sensors, a decision operation to determine whether the attitude of the shovel has been set in the initial attitude, and a relief operation to place the shovel in a hydraulic relief state.

4. The shovel as claimed in claim 1, further comprising:

a human body detecting sensor configured to detect presence of a person around the shovel during the execution of the preset operation, wherein the hardware processor is configured to execute the preset operation when no person is being detected by the human body detecting sensor.

5. The shovel as claimed in claim 1, further comprising:

a human body detecting sensor configured to detect presence of a person around the shovel during the execution of the preset operation, wherein the hardware processor is configured to stop the preset operation when the human body detecting sensor detects a person during the execution of the preset operation.

6. A method for controlling a shovel that includes a lower traveling body, an upper rotating body rotatably mounted on the lower traveling body, a rotation drive mechanism configured to rotate the upper rotating body relative to the lower traveling body, an attachment attached to the upper rotating body, the attachment including a boom, an arm, and an end attachment, state detecting sensors configured to detect operational states of components of the shovel and including an attitude sensor configured to detect an attitude of the attachment, and a hardware processor, the method comprising:

executing, by the hardware processor, a preset operation of at least one of the attachment and the rotation drive mechanism based on a detection value detected by the attitude sensor;

associating, by the hardware processor, detection values detected by the state detecting sensors during execution of the preset operation of the at least one of the attachment and the rotation drive mechanism with the present operation; and storing, by the hardware processor, the detection values associated with the preset operation in a storage.

7. The method as claimed in claim 6, wherein the preset operation is executed while a gate lock lever is in an unlocked state.

8. The method as claimed in claim 6, wherein the preset operation includes an initial operation to set the attitude of the shovel in an initial attitude before the operational states are detected by the state detecting sensors, a decision operation to determine whether the attitude of the shovel has been set in the initial attitude, and a relief operation to place the shovel in a hydraulic relief state.

9. The method as claimed in claim 6, wherein the preset operation is executed when no person exists around the shovel.

10. The method as claimed in claim 6, wherein the preset operation is stopped when a person enters an area around the shovel during the execution of the preset operation.

11. A mobile information terminal that communicates with a shovel including a lower traveling body, an upper rotating body rotatably mounted on the lower traveling body, a rotation drive mechanism configured to rotate the upper rotating body relative to the lower traveling body, an attachment attached to the upper rotating body, the attachment including a boom, an arm, and an end attachment, and state detecting sensors configured to detect operational states of components of the shovel and including an attitude sensor configured to detect an attitude of the attachment, the mobile communication terminal comprising:

a hardware processor programmed to transmit a command to the shovel to cause the shovel to execute a preset operation of at least one of the attachment and the rotation drive mechanism based on a detection value detected by the attitude sensor, cause the shovel to associate detection values detected by the state detecting sensors during execution of the preset operation of the at least one of the attachment and the rotation drive mechanism with the present operation, and cause the shovel to store the detection values associated with the preset operation in a storage.

12. The mobile information terminal as claimed in claim 11, wherein the hardware processor is programmed to transmit the command to the shovel to cause the shovel to execute the preset operation while a gate lock lever is in an unlocked state.

13. The mobile information terminal as claimed in claim 11, wherein the preset operation includes an initial operation to set the attitude of the shovel in an initial attitude before the operational states are detected by the state detecting sensors, a decision operation to determine whether the attitude of the shovel has been set in the initial attitude, and a relief operation to place the shovel in a hydraulic relief state.

* * * * *